US011047100B2

(12) United States Patent
Runggaldier et al.

(10) Patent No.: US 11,047,100 B2
(45) Date of Patent: Jun. 29, 2021

(54) APPARATUS FOR MAKING A CROSS-COUNTRY SKI RUN

(71) Applicant: Prinoth S.p.A., Vipiteno (IT)

(72) Inventors: Martin Runggaldier, S. Cristina (IT); Mirko Insam, Ortisei (IT); Stefan Baier, Luxembourg (LU)

(73) Assignee: Prinoth S.p.A., Vipiteno (IT)

( * ) Notice: Subject to any disclaimer, the term of this patent is extended or adjusted under 35 U.S.C. 154(b) by 229 days.

(21) Appl. No.: 16/061,263

(22) PCT Filed: Dec. 14, 2016

(86) PCT No.: PCT/IB2016/057616
§ 371 (c)(1),
(2) Date: Jun. 11, 2018

(87) PCT Pub. No.: WO2017/103810
PCT Pub. Date: Jun. 22, 2017

(65) Prior Publication Data

US 2018/0363260 A1 Dec. 20, 2018

(30) Foreign Application Priority Data

Dec. 14, 2015 (IT) ..... 102015000083039

(51) Int. Cl.
*E01H 4/02* (2006.01)
*A63C 19/10* (2006.01)

(52) U.S. Cl.
CPC ..... *E01H 4/02* (2013.01); *A63C 19/10* (2013.01)

(58) Field of Classification Search
CPC ..... E01H 4/02; E01H 4/00; A63C 19/10
See application file for complete search history.

(56) References Cited

U.S. PATENT DOCUMENTS 4,348,825 A * 9/1982 Bachler ..... E01H 4/02 172/199
4,523,398 A * 6/1985 Scheibel ..... E01H 4/02 172/140
4,559,725 A * 12/1985 Wieland ..... E01H 4/02 37/197

(Continued)

FOREIGN PATENT DOCUMENTS

EP 0 450 138 A1 10/1991
EP 0 461 303 A1 12/1991

(Continued)

OTHER PUBLICATIONS

Notification of the Recording of a Change for International Application No. PCT/IB2016/057616 dated Oct. 20, 2017.

(Continued)

*Primary Examiner* — Jamie L McGowan
(74) *Attorney, Agent, or Firm* — Neal, Gerber & Eisenberg LLP

(57) ABSTRACT

An apparatus configured to make ski runs comprising a support structure; a first tiller; at least one tracksetting device; and a connection structure that couples the tracksetting device to the first tiller; the connection structure being configured to allow the free rotation about an axis, such as transverse to the advancing direction, of the tracksetting device with respect to the tiller.

19 Claims, 5 Drawing Sheets

(56) References Cited

U.S. PATENT DOCUMENTS 4,560,303 A * 12/1985 Haug ..... E01H 4/02 37/219
4,738,037 A * 4/1988 Haug ..... E01H 4/02 37/222
4,788,783 A * 12/1988 Bachler ..... E01H 4/02 172/393
5,067,263 A * 11/1991 Pelletier ..... E01H 4/02 37/197
5,659,984 A * 8/1997 Haug ..... A62D 3/02 37/219
5,809,671 A * 9/1998 Sinykin ..... E01H 4/02 172/250
6,671,983 B2 * 1/2004 Quenzi ..... E01H 4/02 37/222
6,810,609 B2 * 11/2004 Lassonde ..... E01H 4/02 172/123
7,546,700 B2 * 6/2009 Westmont ..... E01H 4/02 37/223
2003/0051376 A1 * 3/2003 Lassonde ..... E01H 4/02 37/348
2003/0154633 A1 * 8/2003 Lassonde ..... E01H 4/02 37/219
2004/0144000 A1 * 7/2004 Kanzler ..... E01H 4/02 37/196
2008/0184602 A1 * 8/2008 Westmont ..... E01H 4/02 37/223
2019/0119872 A1 * 4/2019 Saggiorato ..... E01H 4/02

FOREIGN PATENT DOCUMENTS

EP 1 754 832 A2 2/2007
EP 2 468 959 A1 6/2012

OTHER PUBLICATIONS

Notification Concerning Submission, Obtention or Transmittal of Priority Document for International Application No. PCT/IB2016/057616 dated Apr. 4, 2017.
Notification of Transmittal of the International Search Report and the Written Opinion for International Application No. PCT/IB2016/057616 dated Mar. 31, 2017.

* cited by examiner

APPARATUS FOR MAKING A CROSS-COUNTRY SKI RUN

PRIORITY CLAIM

This application is a national stage application of PCT/IB2016/057616, filed on Dec. 14, 2016, which claims the benefit of and priority to Italian Patent Application No. 102015000083039, filed on Dec. 14, 2015, the entire contents of which are each incorporated by reference herein.

TECHNICAL FIELD

The present disclosure relates to an apparatus configured to make a cross-country ski run, in particular a classic-technique cross-country ski run.

BACKGROUND

Certain known apparatuses usually comprise a main tiller and at least one tracksetting device comprising at least one runner and configured to create tracks in the snow. A track for a cross-country ski run is a furrow having a flat bottom surface, two splayed side surfaces, and the function of guiding a ski. A track is formed by pressing the runner on the snowpack and simultaneously advancing the runner along a given route. Basically, the snowpack is locally compacted and deformed in correspondence to each track by the runner.

Depending on the characteristics of the snowpack and to facilitate making the tracks, the snowpack can be tilled beforehand to facilitate making the tracks. Depending on the environmental conditions, sometimes it may be useful to till a more-or-less deep surface layer of the snowpack before making the tracks, while other times it is not necessary. That is, the characteristics of the snowpack can vary significantly depending on the environmental conditions. In other words, the snowpack can be soft or compact, or have a hard surface crust and be relatively soft inside, to mention just a few of the characteristics that the snowpack may assume according to the temperature, humidity and temperature range. Making tracks and the structure they have can be heavily influenced by the variability of the snowpack's characteristics. To this end, the position of the main tiller can be varied to adjust the tilling depth level in the snowpack according to needs. However, the position of the main tiller affects the quality of the tracks in the snow in a manner that is not always positive.

In other words, such known apparatuses do not enable obtaining a relatively high level of quality for classic-technique cross-country ski runs and a relatively high speed of advancement for all the various types of snowpack.

SUMMARY

One advantage of the present disclosure is to provide an apparatus configured to make cross-country ski run that reduces certain of the drawbacks of certain of the known art.

According to the present disclosure, an apparatus is provided for making ski runs comprising a support structure, a first tiller, at least one tracksetting device, and a connection structure that couples the tracksetting device to the first tiller and/or to the support structure, the connection structure being configured to enable or allow the free rotation about an axis, such as an axis transverse to an advancing direction, of the tracksetting device with respect to the tiller. As such, the position of the tracksetting device with respect to the blanket of snow of the present disclosure is independent of the position of the tiller with respect to the blanket of snow.

This enables having relatively greater adaptability to the conditions of the snowpack and, in consequence, better relative quality for the ski runs.

According to certain embodiments, the connection structure comprises a first articulated joint that connects the tiller to the tracksetting device.

According to another embodiment, the connection structure comprises a second articulated joint that connects the tiller to the support structure in a freely rotating manner.

According to another embodiment, the connection structure comprises a third articulated joint and a first arm that connects the third articulated joint to the second articulated joint.

According to another embodiment, the apparatus comprises a first actuator, the tiller comprises a frame, and the first actuator has a selectively adjustable length that connects the frame of the tiller to the third articulated joint so that the distance of the frame with respect to the third articulated joint is selectively adjustable.

According to another embodiment, the apparatus comprises a fourth articulated joint and a second arm that connects the fourth articulated joint to the third articulated joint, the tracksetting device being connected to the fourth articulated joint in a freely rotating manner.

According to another embodiment, the connection structure comprises a guide connected to the first articulated joint, the tracksetting device being connected to the guide.

According to another embodiment, the connection structure defines an articulated quadrilateral having four articulated joints and connects the tracksetting device to the tiller so that the tracksetting device freely rotates about the axis with respect to tiller to assume a position with respect to the snowpack that is independent of the position of the tiller with respect to the snowpack. In certain embodiments, the support structure is connected to one of the four articulated joints.

According to another embodiment, the connection structure comprises a fifth articulated joint connected to the tiller at a different point from the first articulated joint.

According to another embodiment, the apparatus comprises an actuator having a selectively adjustable length, and the connection structure comprises a sixth articulated joint connected to the fifth articulated joint by the actuator so that the distance between the fifth articulated joint and the sixth articulated joint is selectively adjustable, the sixth articulated joint being connected to the tracksetting device.

According to another embodiment, the tracksetting device comprises a support structure, a second tiller, and a pan, the support structure being connected to the first tiller by the connection structure.

According to another embodiment, the second tiller is connected to the support structure by a seventh articulated joint and by a third arm selectively constrained to a body of the support structure by an actuator.

According to another embodiment, the pan is connected to an elongated portion of the support structure, the elongated portion being connected to a body of the support structure by an eighth articulated joint and by an actuator so as to constrain the position of the elongated body with respect to the body in a selectively adjustable manner.

According to another embodiment, the second tiller is arranged between the first tiller and the pan along an advancement direction.

Additional features and advantages are described in, and will be apparent from the following Detailed Description and the figures.

BRIEF DESCRIPTION OF THE DRAWINGS

Further characteristics and advantages of the present disclosure will become clear from the description that follows of a non-limitative embodiment, with reference to the figures in the accompanying drawings, in which.

DETAILED DESCRIPTION

Figure 1:
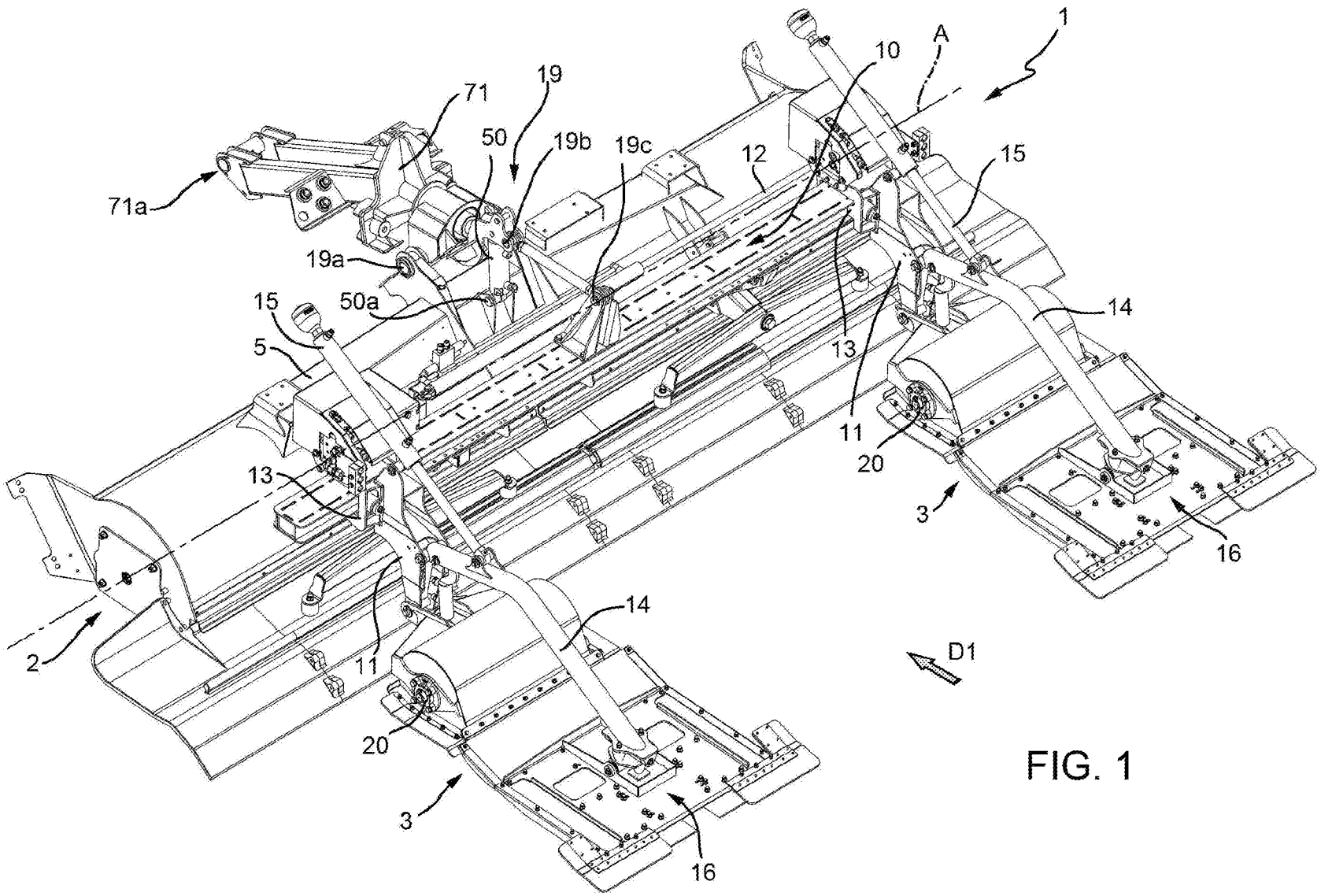
FIG. 1 is a perspective view, with parts removed for clarity, of an apparatus configured to make tracks for a cross-country ski run in accordance with a first embodiment of the present disclosure.
Figure 2:
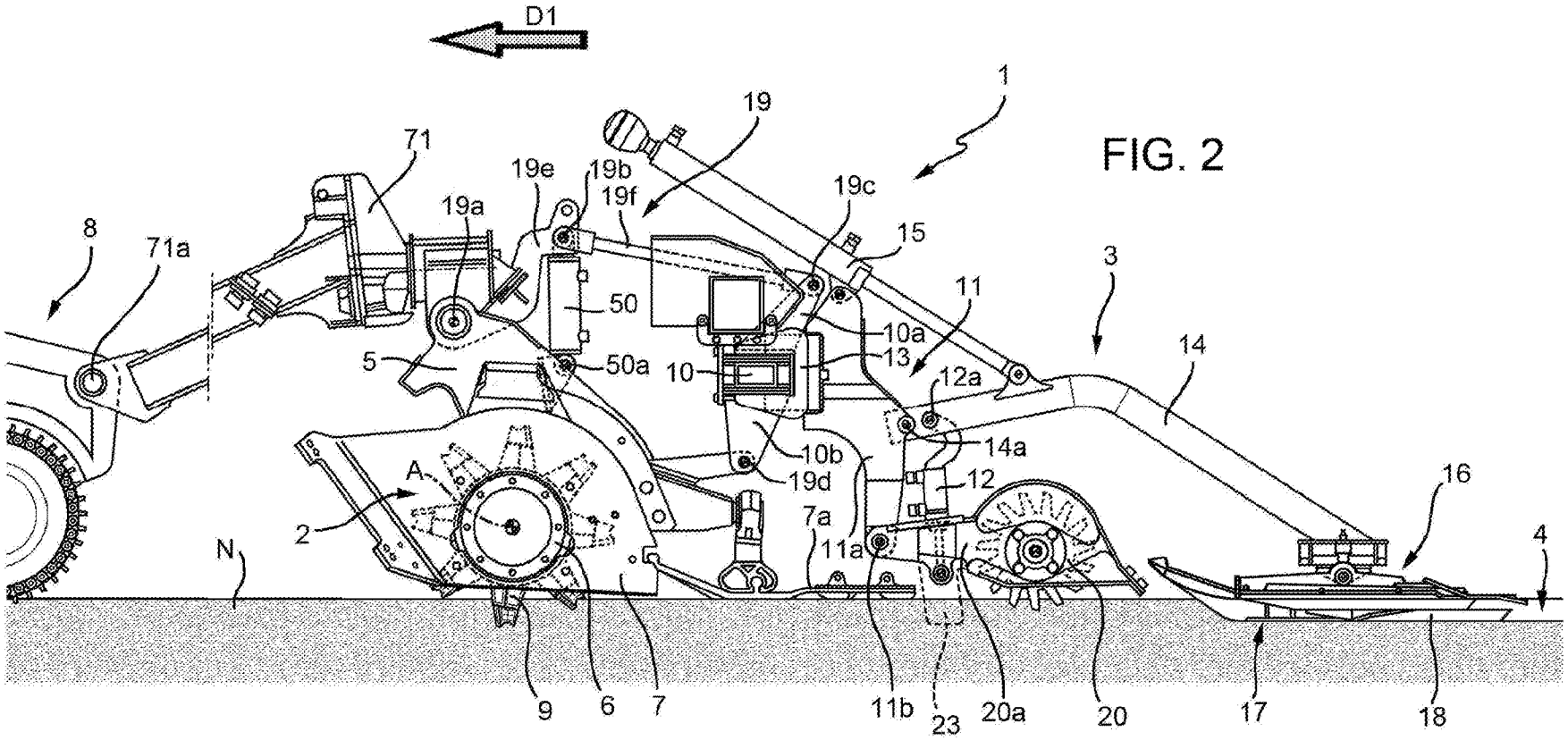
FIG. 2 is a side elevation view, with parts removed for clarity, of the apparatus in FIG. 1 in a first operating configuration.

Referring now to the example embodiments of the present disclosure illustrated in FIGS. 1 to 5 and specifically with reference to FIGS. 1 and 2, an apparatus configured to make a cross-country ski run, in particular of the alternate stride type, is indicated as a whole by reference numeral 1. In the case shown in FIG. 1, the apparatus 1 comprises a support structure 71 configured to support the apparatus 1, a snow tiller 2 supported by the support structure 71, two tracksetting devices 3 to each form two tracks 4 parallel to a direction D1 that corresponds to the advancement direction of the apparatus 1, and a connection structure 19 configured to connect the tracksetting devices 3 to the tiller 2 in an articulated manner to allow or enable rotation about an axis transverse to the direction D1 of the tracksetting devices 3 with respect to the tiller 2.

The number of two tracksetting devices is purely indicative and the present disclosure relates to the single tracksetting device or to a machine equipped with more than two tracksetting devices.

In greater detail, each track 4 is substantially defined by a furrow having a cross section substantially with the form of an isosceles trapezium.

The apparatus 1 is drawn by a vehicle 8 and is connected to the vehicle 8 by the support structure 71. In greater detail, the support structure 71 comprises a connection unit 71*a* configured to be connected to the vehicle 8. The vehicle 8 is, but not limited to, a tracked vehicle, such as a groomer.

With reference to FIG. 2, the tiller 2 comprises a frame 5, a shaft 6, a casing 7 placed around the shaft 6 and a mat 7*a* made of a flexible material.

The shaft 6 is mounted so as to rotate about an axis A and is fitted with teeth 9.

The tiller 2 is supported by the support structure 71. In particular, the tiller 2 is connected to the support structure 71 via the connection structure 19.

The connection structure 19 comprises an articulated joint 19*a*, an articulated joint 19*b*, an articulated joint 19*c*, an articulated joint 19*d*, an arm 19*e* that connects articulated joint 19*a* and articulated joint 19*b*, an arm 19*f* that connects articulated joint 19*b* and articulated joint 19*c*, and a guide 10.

The frame 5 of the tiller 2 is connected directly to the support structure 71 by articulated joint 19*a*. In addition, arm 19*e* is connected to articulated joint 19*a* and to the support structure 71. The frame 5 of the tiller 2 is connected to the support structure 71 at articulated joint 19*b* of the support structure 71.

The apparatus 1 comprises an actuator 50 that connects articulated joint 19*b* to the frame 5 of the tiller 2 and is configured to alter its length. In greater detail, the actuator 50 is connected to articulated joint 19*b* and to the frame 5 at a connection point 50*a* different from articulated joint 19*a*. In consequence, the distance between the frame 5 and articulated joint 19*b* can selectively vary according to the variable length of the actuator 50.

The inclination of the tiller 2 with respect to a snowpack N can be adjusted by acting on a position of the support structure 71 and on the length of the actuator 50.

With reference to FIG. 1, the guide 10 of the connection structure 19 is substantially parallel to axis A. The two tracksetting devices 3 are slidingly mounted along the guide 10. Furthermore, the guide 10 is connected to articulated joint 19*c* by an arm 10*a* and to articulated joint 19*d* by an arm 10*b*.

In greater detail, the guide 10 is connected to the tiller 2 by articulated joint 19*d*. In particular, the guide 10 is connected to the frame 5 of the tiller 2 by articulated joint 19*d* of the connection structure 19.

Figure 3:
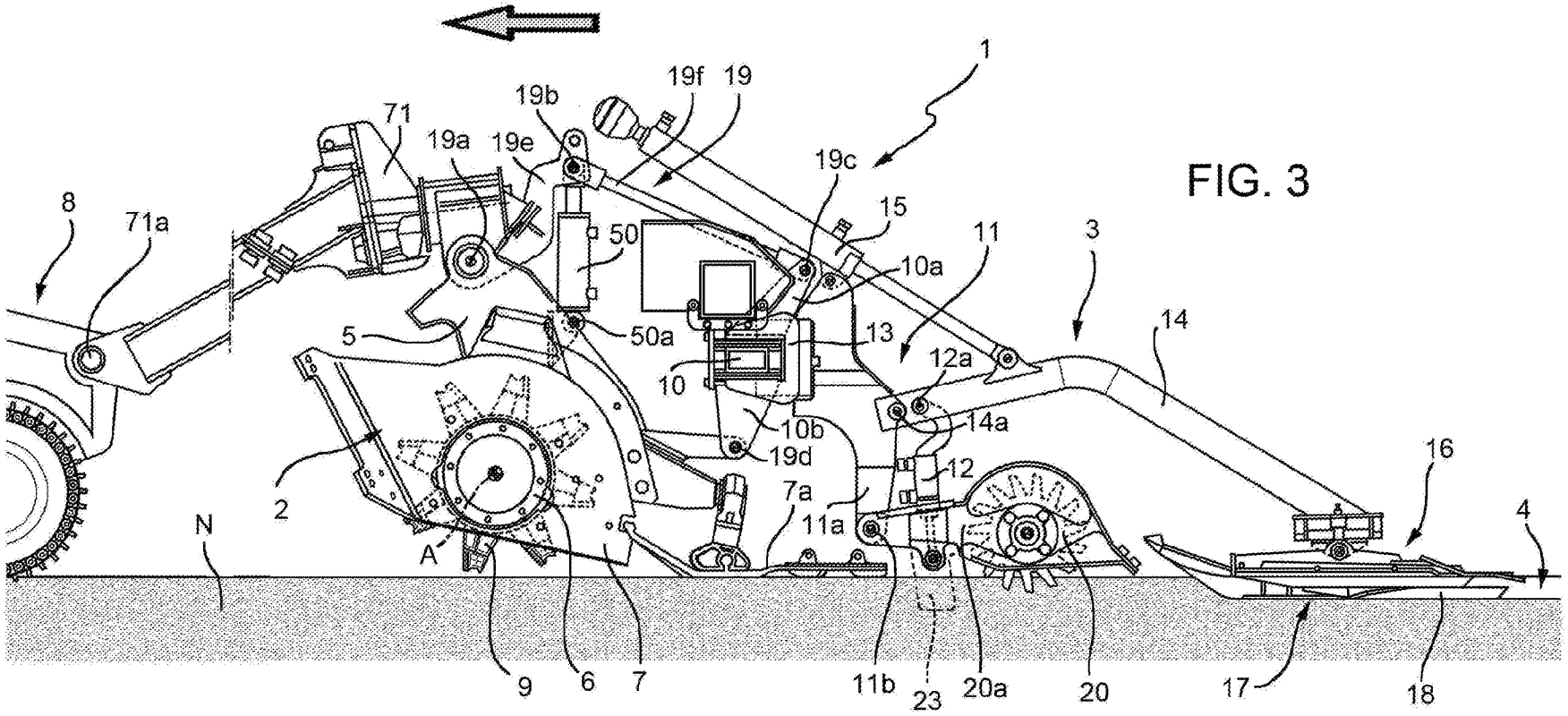
FIG. 3 is a side elevation view, with parts removed for clarity, of the apparatus in FIG. 1 in a second operating configuration.

With reference to FIGS. 1 to 3, each tracksetting device 3 comprises a support structure 11 that is coupled to the guide 10, an actuator 15, a pan 16, and a tiller 20.

Furthermore, each tracksetting device 3 is connected to the support structure 71 and to the tiller 2 by the connection structure 19 so as to allow free rotation, such as about an axis parallel to axis A, with respect to the tiller 2 and to the support structure 71. Each support structure 11 comprises a body 13 defined like a slider engaged by the guide 10 and an elongated portion 14, which is hinged to the body 13. The actuator 15 is placed between the body 13 and the elongated portion 14 to selectively arrange the elongated portion 14 in a working position, in which the tracksetting device 3 is in contact with the snowpack N and makes the tracks 4, and a rest position, in which the tracksetting device 3 is raised above the snowpack N and does not make the tracks 4. In the accompanying drawings, the tracksetting device 3 is always in the working position. In greater detail, the elongated portion 14 is connected to the body 13 by an articulated joint 14*a*. The articulated joint 14*a* is constrained by the actuator 15. In other words, the elongated portion 14 is not free to rotate with respect to the body 13 without operation of the actuator 15.

With reference to FIGS. 1 to 3, the pan 16 is connected to the support structure 11 and defined by a plate having a flat bottom surface 17 curved slightly upwards on the front edge; two runners 18, which are connected to the pan 16, protrude downwards with respect to the bottom surface of the pan 16, and are arranged at the rear edge of the pan 16.

The tiller 20 is coupled to the support structure 11. In particular, the tiller 20 is coupled to the elongated portion 14 by an arm 12 on an articulated joint 12*a* and to a central body 11*a* of the support structure 11 on an articulated joint 11*b*. The central body 11*a* is connected to the body 13.

In certain embodiments, the apparatus 1 comprises an actuator that is configured to move the body 13 along the guide 10 and to adjust the distance between the tracksetting devices 3 in a direction transverse to direction D1. In another embodiment not shown in the accompanying drawings, this actuator is omitted.

In one optional embodiment of the present disclosure, the tracksetting device 3 comprises two blades 23 (shown in FIGS. 2 and 3 with broken lines) connected to a frame 20*a* of tiller 20. The blades 23 are arranged between tiller 20 and tiller 7. In this case, each blade 23 is aligned with a runner 18.

The blade 23 has dimensions slightly larger than those of the runners 18 and separates an elongated and continuous portion of snowpack N from the remaining part of the snowpack N. In use, tiller 2 works a wide strip of the snowpack N to a small depth, while tillers 20 work narrow strips to a greater depth. The separation of the elongated and continuous portion causes a crumbling effect of the elongated and continuous portion that facilitates the formation of the track 4.

Each runner 18 is dragged along an elongated and continuous portion and compacts the snowpack N of this elongated and continuous portion through to the compressing action exerted by the actuator 15.

The connection structure 19 defines an articulated quadrilateral for each tracksetting device 3 that connects the tracksetting device 3 to the tiller 2 and the support structure 71. The articulated quadrilateral is formed by articulated joints 19*a*, 19*b*, 19*c* and 19*e*, by elements 19*e* and 19*f*, by a portion of the frame 5 of the tiller 2 interposed between articulated joint 19*a* and articulated joint 19*d*, by arms 10*a* and 10*b*, and by the guide 10 interposed between articulated joint 19*c* and articulated joint 19*d*.

It should be appreciated that in accordance with the present disclosure, the position of the tiller 2 with respect to the snowpack N can be varied via the actuator 50 and/or the position of the support structure 71, without altering the position of tiller 20 with respect to the snowpack N. In fact, as can be seen in FIGS. 2 and 3, the position of tiller 2 varies from a first operating position to a second operating position, but the position of tiller 20 with respect to the snowpack N does not change due to the articulated connection provided by the connection structure 19. In other words, the connection structure 19 provides a freely articulated linkage between the tiller 2, the support structure 71 and the tracksetting device 3. In consequence, the position of the tracksetting device 3 is not altered by the position of tiller 2 and can be adjusted by the actuator 15, which acts on the elongated portion 14 that is connected to the body 13 of the support structure 11.

According to a further variant, not shown in the accompanying drawings, the runner and the blades of the tracksetting device are movable in the direction transverse to a designated direction D1 so as to adjust the distance between two adjacent tracks. In this case, the runners and the blades are mounted on respective guides and connected to actuators that enable remotely adjusting their relative position so as to adjust the distance between the tracks. For example, European Patent Document No. 450,138 describes a device configured to adjust the track width of the runners. That is, on bends, it is necessary to increase the distance between the two adjacent tracks with respect to the distance between straight tracks to allow the skier's natural movement in seeking areas of support that ensure relatively greater stability on bends.

Figure 4:
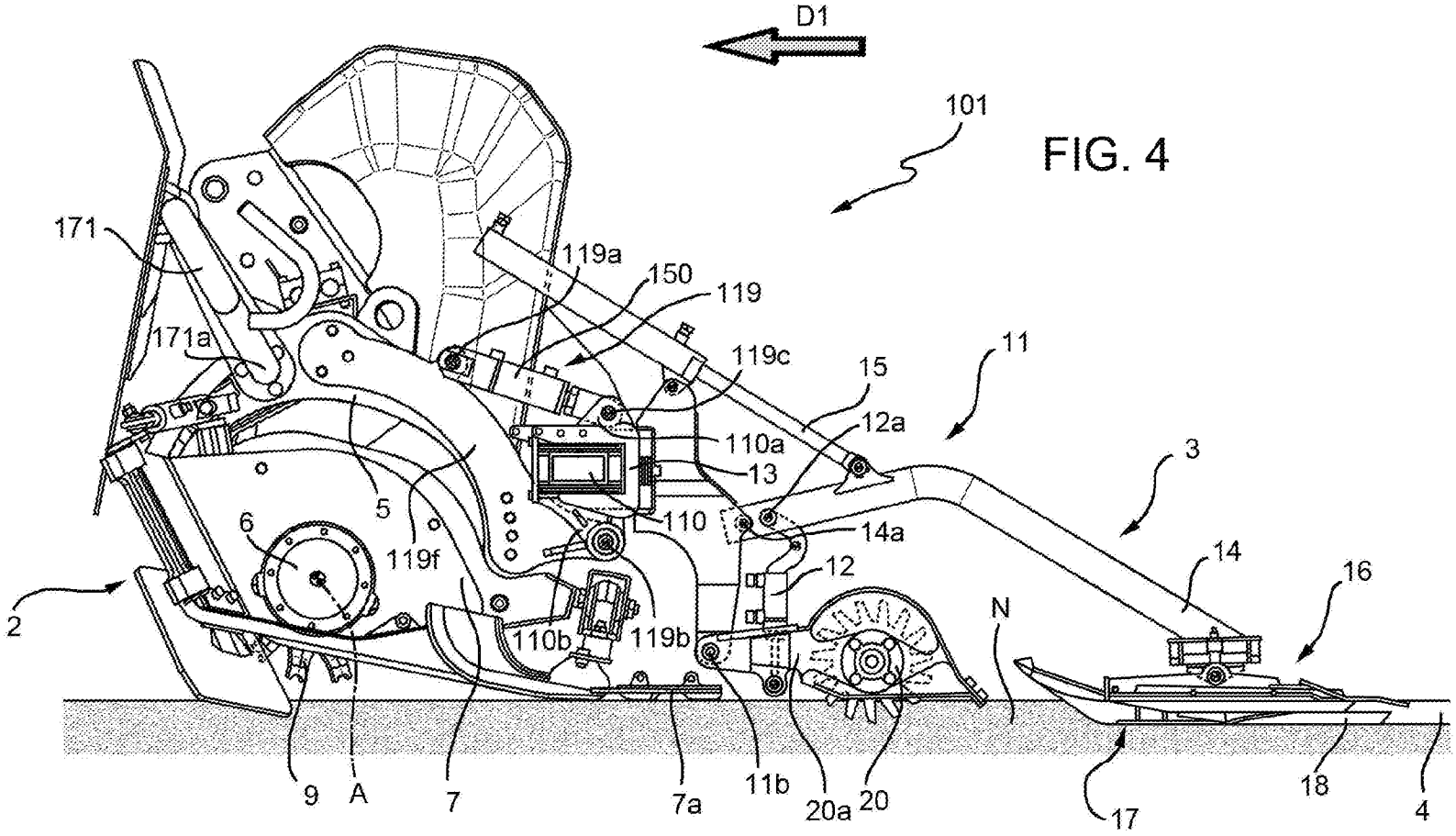
FIG. 4 is a side elevation view, with parts removed for clarity, of an apparatus configured to make tracks for a cross-country ski run in accordance with a second embodiment of the present disclosure.
Figure 5:
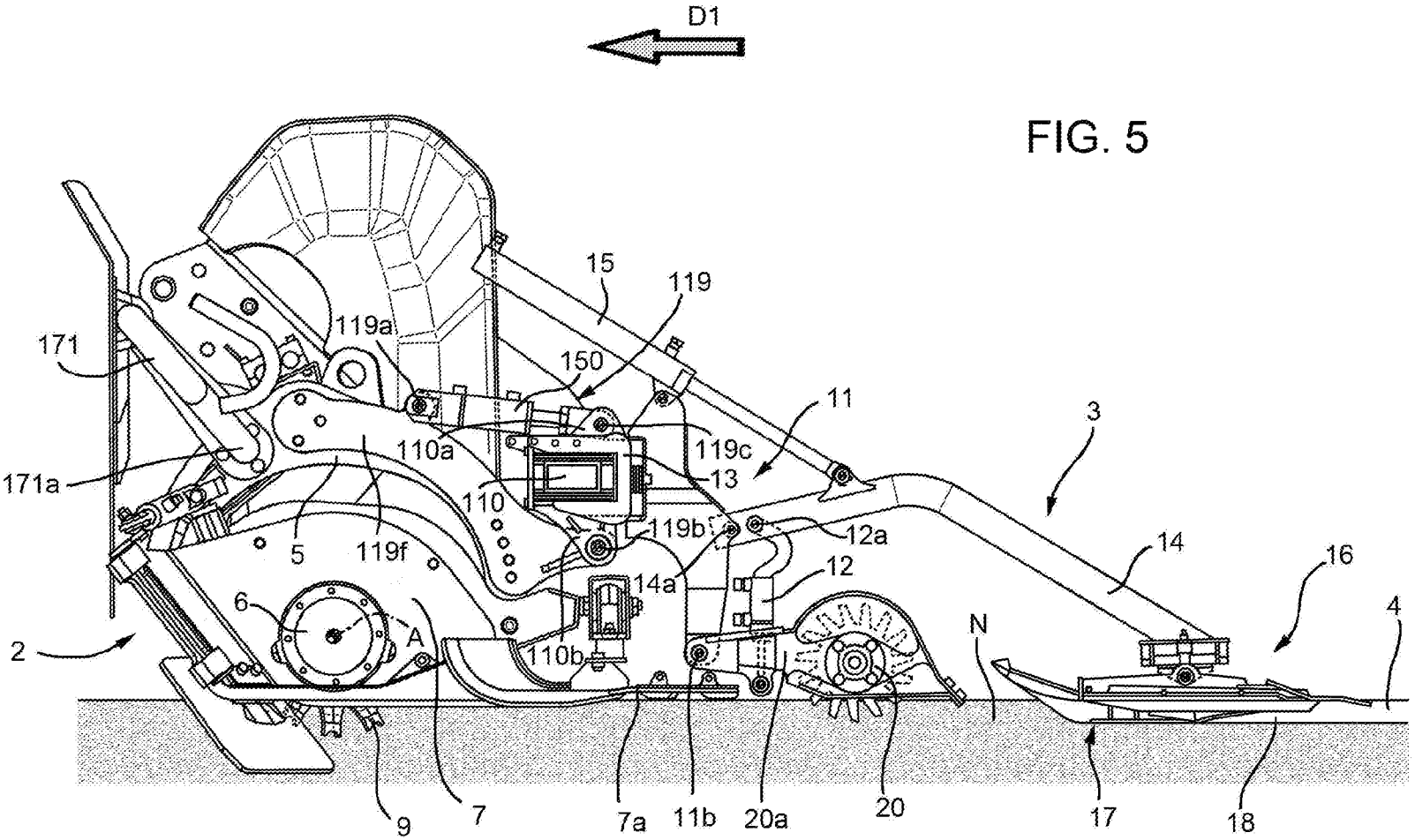
FIG. 5 is a side elevation view, with parts removed for clarity, of the apparatus in FIG. 4 in a second operating configuration.

With reference to FIGS. 4 and 5, reference numeral 101 indicates a second embodiment of an apparatus configured to make a cross-country ski run, in alternative to apparatus 1. In the case shown in FIG. 4, the apparatus 101 comprises a support structure 171 configured to support the apparatus 101, a snow tiller 2 supported by the support structure 171, four tracksetting devices 3 to each form two tracks 4 parallel to a direction D1 that corresponds to the advancement direction of the apparatus 101, and a connection structure 119 configured to connect the tracksetting devices 3 to the tiller 2 in an articulated manner to enable rotation about an axis transverse to the direction D1 of the tracksetting devices 3 with respect to the tiller 2.

The number of four tracksetting devices is purely indicative and the present disclosure relates to any number of tracksetting devices from one to more than four.

The apparatus 101 is drawn by a vehicle 8 and is connected to the vehicle 8 by the support structure 171.

The tiller 2 and the tracksetting devices 3 of the apparatus 101 are made in the same way as those of apparatus 1 and are shown with the same reference numerals, and will not be further described.

Apparatus 101 mainly differs from apparatus 1 in the connection structure 119.

The tiller 2 is directly supported by the support structure 171. The frame 5 of the tiller 2 is connected directly to the support structure 171 at a connection point 171*a*.

Furthermore, the tracksetting devices 3 are connected to the tiller 2 by the connection structure 119 and are not directly connected to the support structure 171. In other words, unlike apparatus 1, in apparatus 101 the tracksetting devices 3 are only connected to the tiller 2 by the connection structure 119. In consequence, the connection structure 119 only extends from the tiller 2 to the tracksetting devices 3.

The connection structure 119 comprises a guide 110, and an elongated element 119*f* connected along the frame 5 of the tiller 2. In addition, the connection structure 119 comprises an articulated joint 119*a*, an articulated joint 119*b* and an articulated joint 119*c*. The articulated joint 119*a* and articulated joint 119*b* are connected to the elongated element 119*f* of the connection structure 119.

Furthermore, the apparatus 101 comprises an actuator 150 that is interposed between articulated joint 119*a* and articulated joint 119*c* and connects them to one another. The actuator 150 is selectively adjustable in length, and so the distance between articulated joint 110*a* and articulated joint 119*c* is variable.

In consequence, the distance between the tiller 2 and the tracksetting devices 3 can selectively vary on the basis of the variable length of the actuator 150.

The inclination of the tiller 2 with respect to a snowpack N can be adjusted by acting on a position of the support structure 171.

With reference to FIGS. 4 and 5, the guide 110 of the connection structure 119 is substantially parallel to axis A. The tracksetting devices 3 are slidingly mounted along the guide 110. Furthermore, the guide 110 is connected to articulated joint 110*c* by an arm 110*a* and to articulated joint 119*b* by an arm 110*b*.

In particular, the guide 110 is only connected to the frame 5 of the tiller 2.

Furthermore, each tracksetting device 3 is connected to the tiller 2 by the connection structure 119 so as to allow free rotation, such as about an axis parallel to axis A, with respect to the tiller 2.

The connection structure 119 defines a structure with three sides, in which the length of one of the sides varies, for each tracksetting device 3, and which connects the tracksetting device 3 to the tiller 2 by the guide 110. The three-sided structure is formed by articulated joints 119*a*, 119*b* and 119*c*, by elements 119*f*, by the guide 110 and by arms 110*a* and 110*b* of the guide 110, and by the actuator 150.

It should be appreciated that in accordance with the present disclosure, the position of tiller 2 with respect to the snowpack N can be varied through the actuator 150, without altering the position of tiller 20 with respect to the snowpack N. That is, as can be seen in FIGS. 4 and 5, the position of tiller 2 varies from a first operating position to a second operating position, but the position of tiller 20 with respect to the snowpack N does not change thanks to the variation in length of the actuator 150, which compensates the variation in the position of tiller 2. In other words, the connection structure 19 provides an articulated connection between the tiller 2 and the tracksetting device 3. In consequence, the position of the tracksetting device 3 is not altered by the position of tiller 2 and can be adjusted by the actuator 15, which acts on the elongated portion 14 that is connected to the body 13 of the support structure 11.

In one embodiment of the present disclosure, not shown in the accompanying drawings, the apparatus 101 comprises control unit that acts on the actuator 150 to adjust the length of the actuator 150 and on the support structure 171 for the position of the support structure 171 and, in consequence, the position of tiller 2. In other words, the movement of the support structure 171 and the movement of the actuator 150 are controlled by the control unit in a synchronous manner so that when the position of the support structure 171 changes to vary the position of tiller 2, the position of the tracksetting device 3 does not vary. Put differently, utilization of the control unit, which simultaneously controls both the position of the support structure 171 and the actuator 150, provides that the position of the tracksetting device 3 is independent of the position of tiller 2.

Finally, it is evident that modifications and variants can be made with regard to the apparatus without departing from the scope of the appended claims. As such, the present disclosure also covers embodiments not described in the detailed description and equivalent embodiments that fall within scope of the appended claims. Accordingly, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A ski run making apparatus comprising:

a support structure;

a first tiller comprising a frame;

a tracksetting device;

a connection structure comprising a first articulated joint that connects the tracksetting device to the first tiller, a second articulated joint that freely rotatably connects the first tiller to the support structure, a third articulated joint and a first arm that connects the third articulated joint to the second articulated joint, wherein the connection structure is configured to enable free rotation about an axis, transverse to an advancing direction, of the tracksetting device with respect to the first tiller such that a position of the first tiller with respect to a snowpack can be varied without altering a position of the tracksetting device with respect to the snowpack; and a first actuator having a selectively adjustable length that connects the frame of the first tiller to the third articulated joint such that a distance between the frame of the first tiller and the third articulated joint is selectively adjustable.

2. The ski run making apparatus of claim 1, wherein the connection structure comprises a fourth articulated joint and a second arm that connects the fourth articulated joint to the third articulated joint, wherein the tracksetting device is freely rotatably connected to the fourth articulated joint.

3. The ski run making apparatus of claim 1, wherein the connection structure comprises a guide connected to the tracksetting device and to the first articulated joint.

4. The ski run making apparatus of claim 1, wherein the tracksetting device comprises a second tiller, a sled and a tracksetting device support structure connected to the first tiller by the connection structure.

5. The ski run making apparatus of claim 4, wherein the second tiller is connected to the tracksetting device support structure by an articulated joint and by a second arm selectively constrained to a body of the tracksetting device support structure by an actuator.

6. The ski run making apparatus of claim 5, wherein the sled is connected to an elongated portion of the tracksetting device support structure, the elongated portion of the tracksetting device support structure being connected to the body of the tracksetting device support structure by another articulated joint and by the actuator so as to selectively adjustably constrain a position of the elongated body of the tracksetting device support structure with respect to the body of the tracksetting device support structure.

7. The ski run making apparatus of claim 4, wherein the second tiller is arranged between the first tiller and the sled along the advancement direction.

8. A ski run making apparatus comprising:

a support structure;

a first tiller;

a tracksetting device;

an actuator having a selectively adjustable length; and a connection structure that connects the tracksetting device to the first tiller, wherein the connection structure defines an articulated quadrilateral comprising four articulated joints which connect the tracksetting device to the first tiller such that the tracksetting device is freely rotatable about an axis of the tracksetting device with respect to the first tiller to assume a position with respect to a snowpack that is independent of a position of the first tiller with respect to the snowpack, the connection structure comprising a fifth articulated joint and a sixth articulated joint, the fifth articulated joint is connected the first tiller at a point different from a first articulated joint of the four articulated joints, and the sixth articulated joint is connected to the tracksetting device and connected to the fifth articulated joint by the actuator such that a distance between the fifth articulated joint and the sixth articulated joint is selectively adjustable.

9. A ski run making apparatus comprising:

a support structure configured to support the ski run making apparatus and connect the ski run making apparatus to a vehicle;

a first tiller supported by the support structure;

a tracksetting device;

a connection structure that couples the tracksetting device to the first tiller, wherein:

the connection structure comprises a first articulated joint that connects the first tiller to the tracksetting device;

the connection structure comprises a second articulated joint that is connected to the first tiller at a point different from the first articulated joint, and the connection structure is configured to enable a rotation about an axis, transverse to an advancing direction, of the tracksetting device with respect to the first tiller such that a position of the first tiller with respect to a snowpack can be varied without altering a position of the tracksetting device with respect to the snowpack; and an actuator having a selectively adjustable length, wherein the connection structure comprises a third articulated joint connected to the second articulated joint by the actuator and connected to the tracksetting device such that a distance between the second articulated joint and the third articulated joint is selectively adjustable.

10. The ski run making apparatus of claim 9, wherein the tracksetting device further comprises:

a support structure connected to the first tiller by the connection structure;

a second tiller; and a sled.

11. The ski run making apparatus of claim 10, wherein the second tiller is connected to the support structure by a fourth articulated joint and by an arm selectively constrained to a body of the support structure by an actuator.

12. The ski run making apparatus of claim 10, wherein the sled is connected to an elongated portion of the support structure that is connected to a body of the support structure by a fourth articulated joint and by an actuator to selectively adjustably constrain a position of the elongated body with respect to the body of the support structure.

13. The ski run making apparatus of claim 10, wherein the second tiller is arranged between the first tiller and the sled along the advancement direction.

14. A ski run making apparatus comprising:

a support structure;

a first tiller;

a tracksetting device; and a connection structure defining an articulated quadrilateral having four articulated joints that connect the tracksetting device to the first tiller such that the tracksetting device is freely rotatable about an axis, transverse to an advancing direction, of the tracksetting device to assume a position with respect to a snowpack that is independent of a position of the first tiller with respect to the snowpack, the connection structure comprising a fifth articulated joint connected the first tiller at a point different from a first articulated joint of the four articulated joints which connect the tracksetting device to the first tiller, wherein the connection structure is configured to enable free rotation about the axis of the tracksetting device with respect to the first tiller such that the position of the first tiller with respect to the snowpack can be varied without altering the position of the tracksetting device with respect to the snowpack.

15. The ski run making apparatus of claim 14, wherein the support structure is connected to one of the four articulated joints.

16. The ski run making apparatus of claim 14, wherein the tracksetting device comprises a second tiller, a sled and a tracksetting device support structure connected to the first tiller by the connection structure.

17. The ski run making apparatus of claim 16, wherein the second tiller is connected to the tracksetting device support structure by an articulated joint and by an arm selectively constrained to a body of the tracksetting device support structure by an actuator.

18. The ski run making apparatus of claim 17, wherein the sled is connected to an elongated portion of the tracksetting device support structure, the elongated portion of the tracksetting device support structure being connected to the body of the tracksetting device support structure by another articulated joint and by the actuator so as to selectively adjustably constrain a position of the elongated body of the tracksetting device support structure with respect to the body of the tracksetting device support structure.

19. The ski run making apparatus of claim 16, wherein the second tiller is arranged between the first tiller and the sled along the advancement direction.

* * * * *